US007726754B2

(12) United States Patent
Keller et al.

(10) Patent No.: US 7,726,754 B2
(45) Date of Patent: Jun. 1, 2010

(54) REFRIGERATING DEVICE WITH DOOR OPENING AID

(75) Inventors: Hans Gerd Keller, Giengen (DE); Matthias Mrzyglod, Ulm (DE); Michael Neumann, München (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 265 days.

(21) Appl. No.: 11/918,821

(22) PCT Filed: Apr. 3, 2006

(86) PCT No.: PCT/EP2006/061272

§ 371 (c)(1),
(2), (4) Date: Oct. 17, 2007

(87) PCT Pub. No.: WO2006/120084

PCT Pub. Date: Nov. 16, 2006

(65) Prior Publication Data

US 2008/0231158 A1 Sep. 25, 2008

(30) Foreign Application Priority Data

May 10, 2005 (DE) ..... 10 2005 021 592

(51) Int. Cl.
*A47B 95/00* (2006.01)

(52) U.S. Cl. ..... 312/296; 312/401

(58) Field of Classification Search ..... 312/296, 312/405, 326–329; 277/581, 589, 921, 931–934; 292/DIG. 71
See application file for complete search history.

(56) References Cited

U.S. PATENT DOCUMENTS 2,810,493 A * 10/1957 Eichhorn et al. ..... 220/231
3,055,193 A * 9/1962 Smith ..... 62/440

(Continued)

FOREIGN PATENT DOCUMENTS

DE 8032204 U1 4/1985

(Continued)

OTHER PUBLICATIONS

English translation of DE 44 03 336.*

(Continued)

*Primary Examiner*—Janet M Wilkens
*Assistant Examiner*—Dan Rohrhoff
(74) *Attorney, Agent, or Firm*—James E. Howard; Andre Pallapies

(57) ABSTRACT

The invention relates to a refrigerator having two movably connected housing parts that delimit a heat-insulated interior and a seal member that is fastened to a first of the housing parts and contacts the other of the housing parts in an airtight manner in the closed disposition of both housing parts. A lifting element lifts the seal member from a contact surface on the second housing part to permit pressure compensation between the inner chamber and the surroundings of the refrigerator. The lifting element is at least in part formed by a thermally deformable material and, in a first shape thereof, it establishes a sealed contact between the seal member and the contact surface, and in a second state resulting from the effect of heat or cold, it lifts the seal member from the contact surface in order to ensure pressure compensation.

26 Claims, 5 Drawing Sheets

U.S. PATENT DOCUMENTS

| | | | | |
|---|---|---|---|---|
| 4,653,283 | A * | 3/1987 | Sepso | 62/89 |
| 4,822,980 | A * | 4/1989 | Carbone et al. | 392/453 |
| 4,932,730 | A | 6/1990 | Zeismann et al. | |
| 5,573,323 | A * | 11/1996 | Kim et al. | 312/405 |
| 5,906,423 | A * | 5/1999 | Lyu | 312/405 |
| 6,025,771 | A * | 2/2000 | Kobayashi et al. | 338/22 R |
| 6,672,094 | B1 * | 1/2004 | Carden et al. | 62/273 |
| 7,174,734 | B2 * | 2/2007 | Davern et al. | 62/187 |
| 7,340,916 | B2 * | 3/2008 | Kim | 62/409 |
| 7,448,705 | B2 * | 11/2008 | Park | 312/405 |
| 7,556,324 | B2 * | 7/2009 | Benz | 312/405 |
| 2005/0212304 | A1 * | 9/2005 | Herrera et al. | 292/251.5 |
| 2006/0012190 | A1 * | 1/2006 | Alacqua et al. | 292/341.16 |
| 2006/0021284 | A1 | 2/2006 | Benz | |

FOREIGN PATENT DOCUMENTS

| | | |
|---|---|---|
| DE | 90 06 998 U | 8/1990 |
| DE | 44 03 336 | 11/1994 |
| DE | 10 2004 012 496 | 10/2005 |
| EP | 0 230 887 | 8/1987 |
| JP | 2001-116433 | 4/2001 |

OTHER PUBLICATIONS

International Search Report PCT/EP2006/061272.

* cited by examiner

REFRIGERATING DEVICE WITH DOOR OPENING AID

The present invention relates to a refrigerating device having two movably connected housing parts which together delimit a heat-insulated internal space. The refrigerating device features a seal which is attached to a first of the housing parts, this usually being the door of the refrigerating device, and which—when the housing parts are in a closed position—lies on the other (second) housing part, this usually being the body of the refrigerating device, and closes the internal space in a manner which is essentially airtight. The refrigerating device also features a lifting element for lifting the seal from a contact surface on the second housing part.

BACKGROUND OF THE INVENTION

DE 36 02 200 A1 discloses a refrigerating device of said kind. In the case of this device, a lifting element which is configured on a door handle engages in a fold of a magnetic door seal and, when the door handle is activated, lifts said seal along a part of its length from its contact surface on the body of the refrigerating device. A flow path for air is created thus. This is intended to equalize a negative pressure in the refrigerating device shortly before the door is actually opened, wherein said negative pressure can occur, for example, if warm air enters the internal space when the door is opened and cools down within the internal space after the door is closed. A negative pressure within the internal space of the refrigerating device is disadvantageous because it makes opening the door considerably more difficult. However, it is disadvantageous that the lifting element must be activated manually by pulling on the handle. This gives rise to the hazard that the user opens the door by forcefully pulling on the handle in order to overcome a residual negative pressure, thereby possibly jeopardizing the stability of the device.

SUMMARY OF THE INVENTION

The present invention addresses the problem of providing a refrigerating device of the type cited in the introduction, in which the lifting element is configured in a simple and economical manner and the disadvantages of the prior art are overcome.

The problem is solved by a refrigerating device in accordance with the exemplary embodiments described herein.

The problem is solved by a refrigerating device in accordance with claim 1. The dependent claims relate to preferred embodiments.

Provision is made accordingly for a refrigerating device having two movably connected housing parts, these together delimiting a heat-insulated internal space, and a seal which is attached to a first of the housing parts, preferably a door, and which—when the housing parts are in a closed position—lies on a contact surface of the other (second) housing part, preferably a body, and closes the internal space in a manner which is essentially airtight, and a lifting element for lifting the seal from the contact surface in order to allow an equalization of pressure between the internal space and the surroundings of the refrigerating device. According to the invention, the lifting element is at least partially composed of a thermally deformable material, wherein the lifting element, in a first shape, allows a close-fitting contact between the seal and the contact surface on the second housing part, and can be transformed under the influence of heat or cold into a second shape in which it lifts the seal from the contact surface in order to equalize the pressure. It is therefore possible to activate the lifting element merely be controlling its temperature, e.g. by means of an electrical heating element or by means of heat exchange with a reservoir such as the surroundings or the internal space, for example. A lifting of the seal from its contact surface can therefore take place independently of the activation of a door handle by a user. The lifting of the seal from the contact surface takes place for a predetermined time period of e.g. 15 seconds in the context of the door closing operation.

The thermally deformable material is preferably a bimetal, since this is particularly economical. However, shape-memory alloys can also be used. These have meanwhile become available at relatively low cost. These also allow considerable actuating power and actuating lift to be realized in a lifting element of modest dimensions.

The lifting element preferably lifts the seal along only part of its length from the contact surface. This makes it possible to provide an air passage between the external atmosphere surrounding the refrigerating device and the internal space of the refrigerating device immediately after closing the door by partially lifting the seal, or to maintain this air passage when closing the door, such that air from outside the refrigerating device can flow into the internal space, thereby preventing the formation in the internal space of a negative pressure which hampers an opening of the door. When opening the door, it is therefore merely necessary to overcome the closing force of the magnetic seal which is normally used.

However, other embodiments are also conceivable in which the lifting element pushes the seal away from the contact surface by pushing apart the two housing parts, overcoming any possible negative pressure, thereby facilitating further opening of the door.

In the case of the refrigerating device according to the invention, the lifting element is preferably integrally formed from the thermally deformable material. This allows particularly simple and inexpensive embodiments and requires modest installation depth of the lifting element in the body of the refrigerating device, for example. However, the lifting element can be constructed of one or more sections of different materials, preferably consisting of the thermally deformable material in at least one section.

The thermally deformable material preferably acts directly on the seal, at least in the second shape of the lifting element, i.e. no actuator is provided between the thermally deformable material and the seal. The direct action can be provided in particular by means of a direct contact between the thermally deformable material and the seal; however it is also possible for the thermally deformable material to be provided with a protective layer of non-thermally deformable material in order to protect against chemical or mechanical effects.

The thermally deformable material of the lifting element is preferably in thermal contact with a cold reservoir, such as the internal space of the refrigerating device or the external atmosphere surrounding the refrigerating device, as a result of being located in a space which communicates with the surroundings or the internal space. This ensures a rapid cooling of the lifting element. In particular, if the thermally deformable material is placed in a recess of the contact surface, the thermal contact can be ensured in that the thermally deformable material is only partially covered by the seal when the housing parts are in a closed position. A direct convective heat transfer from the thermally deformable material of the lifting element to the air in the internal space of the refrigerating device or to the external atmosphere is therefore possible.

As a result of being placed in a recess of the contact surface, the lifting element is also protected against external influences. As a result of the embedded arrangement in the recess, the lifting element does not stand out visually, and therefore this also represents an aesthetic solution.

Rapid cooling of the heated deformed lifting element can be achieved if the recess communicates with the internal space, since cool air from the internal space can therefore reach the lifting element.

In its second shape, the lifting element rises preferably at least partially above the contact surface of the seal on the second housing part. In particular, in connection with an arrangement of the lifting element in a recess of the second housing part, this allows simple inexpensive and aesthetic embodiments, in which the lifting element exercises a force of pressure on the seal in order to lift the seal.

In its first shape, the lifting element is preferably flush with the contact surface of the seal on the second housing part, such that the lifting element is advantageously barely noticeable visually. Any penetration of foreign bodies in the recess can be prevented because the lifting element completely occupies the base surface of the recess.

In its first shape, the lifting element is preferably designed as a panel, e.g. in the form of a thin (bimetal) strip. Such a flat embodiment of the lifting element requires only a modest installation depth, and the installation of the lifting element is simplified and rendered inexpensive thus.

The lifting element preferably has a first end which is attached to the second housing part, and in its second shape has a curved form in which a second, free end projects above the contact surface in the direction of the seal. This embodiment is simple and inexpensive.

The seal is preferably a magnetic seal comprising a chamber which extends in a longitudinal direction of the seal and contains magnetic material.

When using such a magnetic seal, the lifting element preferably extends over the entire width of this chamber. In order partially to lift the seal in the region of the lifting element, only a partial deformation of the seal is therefore required and any magnetic force otherwise acting between the contact surface and the seal need not be overcome.

The lifting element preferably extends over only part of the width of the seal. The remaining part of the seal width, over which the lifting element does not extend, can then conform to the contact surface, but without a seal being created by magnetic force in this case. In this way, the air passage into the internal space can to a large extent close automatically as soon as it is no longer held open by inflowing air, and cold losses are reduced to a minimum.

The lifting element is preferably heated by means of a heating entity in the refrigerating device, in order to transform it from its first shape into its second shape. This allows selective heating of the lifting element. However, it is alternatively conceivable to heat the lifting element by means of room air which flows past the lifting element when the door is opened. In this case, it is then necessary for the lifting element to assume its second shape in the presence of normal room temperature, in particular in the range from approximately 15° C. to approximately 35° C. It would also be conceivable for the heating entity to be connected to a chassis heater which is usually present in the refrigerating device, such that the chassis heater is used as a heat source for heating the lifting element. The heating entity is preferably triggered by means of a switch which is activated by opening or closing the door of the refrigerating device. This ensures that, after the door is opened in each case, a pressure equalization process can take place by partially lifting the seal, such that no negative pressure which hampers opening of the door can form in the internal space of the refrigerating device. The switch is preferably the door switch which is usually present in every refrigerating device for activating the internal space lighting. However, it can also be a door switch which is separate from the internal space lighting. The heating entity is preferably switched on when the door is opened and switched off when the door is closed. The lifting element is therefore heated when the door is opened, and converted from its first shape into its second shape. If the door is then closed and the heating entity switched off, the lifting element which is still deformed as a result of heating temporarily holds the seal away from its contact surface at least along a part of its length. Therefore, with the two housing parts being in a closed state, an air flow from outside the refrigerating device can flow into the internal space, thereby preventing the formation of a negative pressure in the internal space. The heating entity preferably features an electrical heating element, in particular a PTC heating element, by means of which short heating times can be achieved.

The refrigerating device can be a refrigerating device or a freezing device.

BRIEF DESCRIPTION OF THE DRAWINGS

Further configurations and advantages of the present invention are explained below with reference to embodiments of the present invention, in which.

DETAILED DESCRIPTION OF THE EXEMPLARY EMBODIMENTS OF THE PRESENT INVENTION

Figure 1:
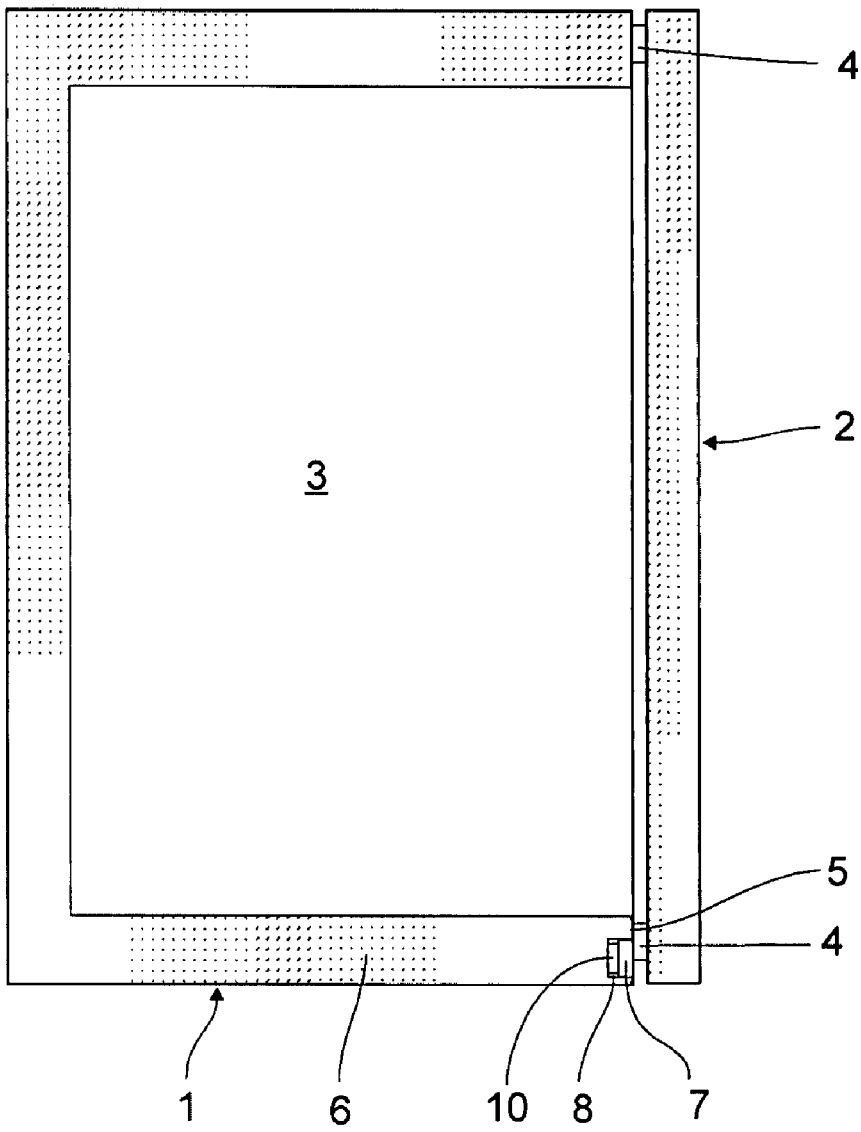
FIG. 1 shows a schematic section through a first embodiment of a refrigerating device according to the invention.

In highly schematic form, FIG. 1 shows a refrigerating device according to the invention, including a body 1 and a door 2 which is linked thereto, these together delimiting an internal space 3, and including a magnetic seal 4 which is attached continuously around the inside of the door 2 and, in a manner which is essentially airtight, clings to a contact surface 5 on the front side of the body 1 by means of magnetic force, such that a negative pressure could develop in the internal space 3 if, following penetration of warm air into the internal space 3, the door 2 were to be closed in an airtight manner and the air in the internal space 3 were to cool down.

A lifting element 7 is arranged in a recess 8 in the heat-insulated wall 6 at the base of the body 1. The lifting element 7 is made of a thermally deformable material such as a shape-memory alloy or a bimetal. A heating entity 10 (a PTC heating element 10 in this case) is arranged underneath the lifting element 7 in the recess 8 and serves to heat the lifting element 7.

Figure 2:
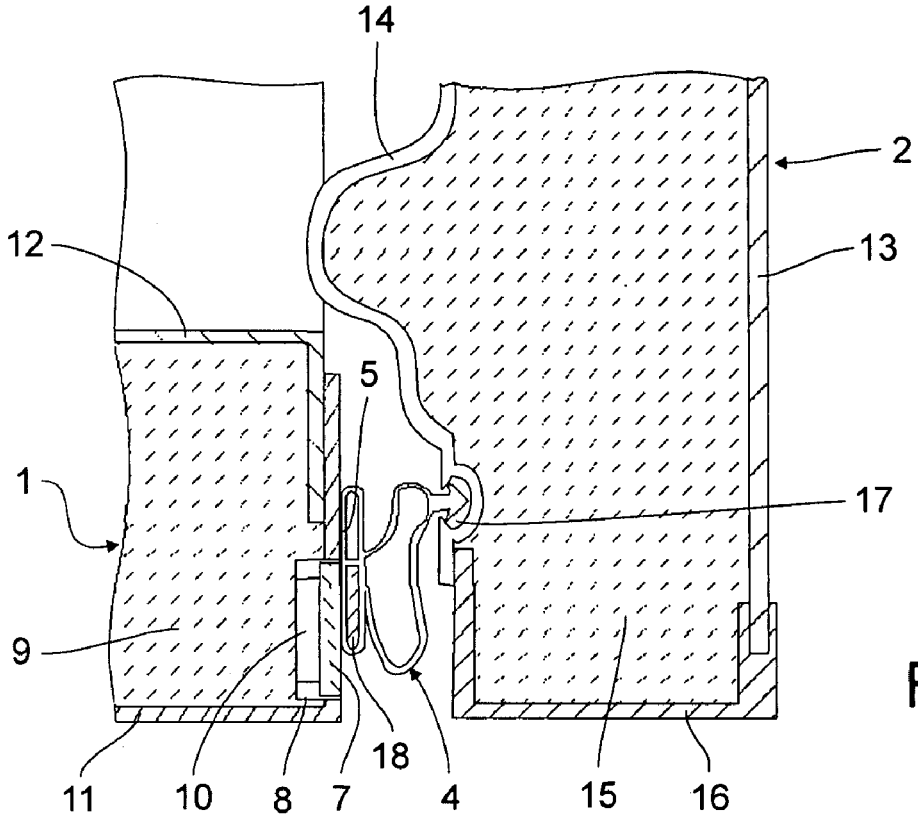
FIG. 2 shows a detailed section through a lower region of the body 1 and the door 2 of the refrigerating device from FIG. 1 in the closed state of the door 2, wherein a seal 4 lies on the body 1.

FIG. 2 shows the lower edge region of the body 1 and the door 2 in a magnified section. The body 1 is constructed of an outer container 11 made of sheet metal and an inner container 12 made of molded plastic, which enclose a hollow space 9 that is filled with insulation material. The outer container 11 forms the chassis-type contact surface 5 for the magnetic seal 4 on the front side of the refrigerating device. Like the body 1, the door 2 of the refrigerating device is constructed of an outer wall 13 made of sheet metal and an inner wall 14 made of molded plastic, which are connected together at their vertical edges and enclose a hollow space 9 that is filled with insulation material and is closed at the top and bottom by plastic profiles 16.

A groove 17 is formed in an edge region of the inner wall 14 and a barbed top section of the magnetic seal 4 is engaged therein. The magnetic seal 4 features a plurality of extended chambers which give it flexibility, wherein one of said chambers, this being designated by the reference numeral 18, is filled with a magnetic material which holds a sealing surface of the magnetic seal 4 pressed onto the sheet metal contact surface 5. In FIG. 2, the lifting element 7 has a first inactive shape in which it is completely contained in the recess 8 of the body 1 and is flush with the contact surface 5 or marginally set back behind it, thereby allowing a close-fitting contact between the magnetic seal 4 and the contact surface 5 on the body 1.

Figure 3:
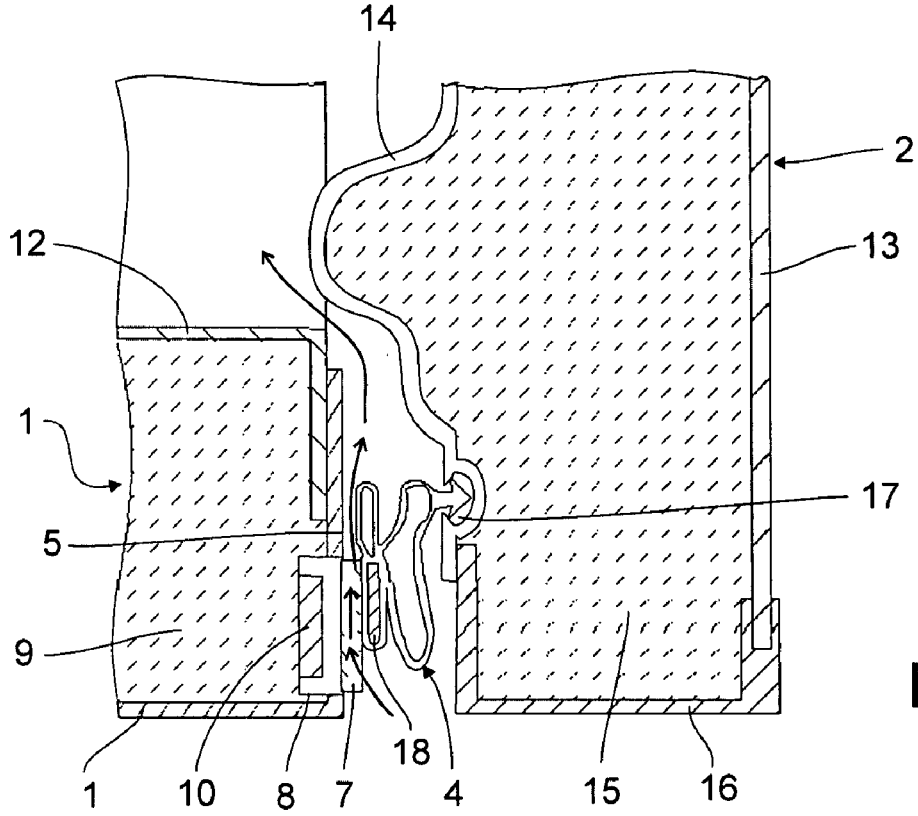
FIG. 3 shows the same section as FIG. 2, wherein the lifting element 7 lifts the seal 4 along a part of its length from the contact surface 5 on the body 1.
Figure 7:
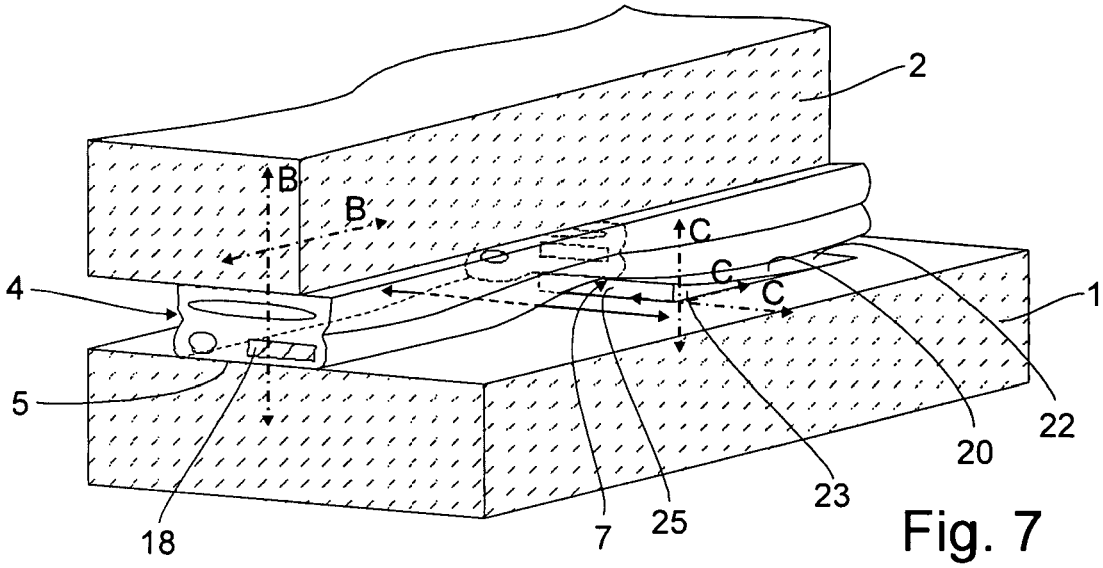
FIG. 7 shows a perspective sectional view corresponding to that shown in FIG. 4, wherein the lifting element 7 lifts the seal 4 over a part of its length from the contact surface 5 on the body 1.

FIG. 3 shows the lifting element 7 in an active second shape in which it rises, from the recess 8, above the contact surface 5 of the magnetic seal 4 and pushes the chamber 18, which is filled with magnetic material, of the magnetic seal 4 away from the body 1. As a result of the gap which is thus produced in front of the lifting element 7 between the body 1 and the magnetic seal 4, as shown in FIG. 7, air can flow into the internal space 3 of the refrigerating device, whereby a pressure equalization takes place between the interior and the exterior. The lifting element 7 of thermally deformable material such as a bimetal is transformed from its first shape into the second shape as a result of heating by means of the heating element 10.

In the present embodiment, the heating element 10 is connected to a door switch (not shown) for activating an internal space lighting (likewise not shown). When the door 2 of the refrigerating device is opened, the switch is activated and the heating element 10 is switched on for as long as the door is open. When the door is closed, the switch is activated again and the heating element 10 is switched off. Said heating element 10 cools down with the lifting element 7 which is still in the second shape. During this cooling period, the magnetic seal 4 remains raised from the body 1 as illustrated in FIG. 3, whereby the formation of a negative pressure in the internal space 3 is avoided because pressure differences which occur between the internal space 3 and the surroundings of the refrigerating device during the cooling period of the lifting element 7 can be equalized by a flow of air from the surroundings of the refrigerating device, and therefore a negative pressure hampering the opening of the refrigerating door is prevented. The lifting element 7 and the heating element 10 are configured such that the magnetic seal 4 remains open for a time period of approximately 5 seconds to one minute after the closing of the door 2, i.e. a time period in which a pressure equalization has essentially taken place. When the door 1 is opened subsequently, only the magnetic force between the magnetic seal 4 and the contact surface 5 on the body 1 need be overcome. The activation of the heating element 10 can also take place via a door switch which is separate from the internal space lighting and is triggered when the door is operated.

As an alternative to the activation of the heating element 10 by means of a door switch as described above, provision can also be made for a switch which is activated immediately before the door 2 is opened, e.g. by pulling on a handle of the door 2. A negative pressure which developed in the internal space 3 after the door 2 was previously opened can therefore be equalized immediately before the door 2 is next opened.

In a variation from the embodiment illustrated in FIGS. 1 to 3, in which the lifting element 7 is arranged on the lower horizontal edge of the body 1, the lifting element 7 can also be arranged on one of the two vertical side edges of the body 1. As an alternative to attaching the magnetic seal 4 to the door 2, it is also conceivable to attach the magnetic seal 4 to the body 1 of the refrigerating device. In this case, the lifting element 7 would then be arranged in a recess of the door 2.

The lifting element 7 is now explained in detail in terms of its structure and functionality with reference to the following schematic FIGS. 4 to 9.

Figure 4:
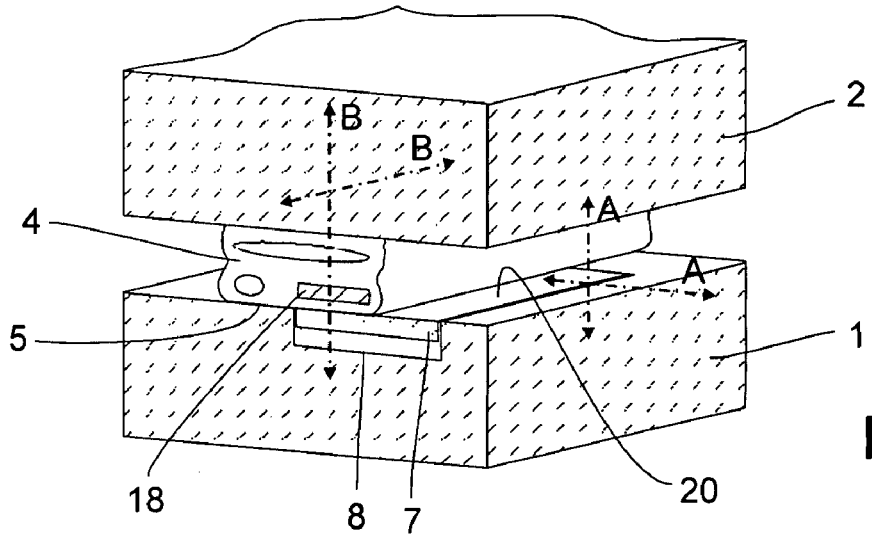
FIG. 4 shows a schematic perspective sectional view through the arrangement shown in FIG. 2.
Figure 5:
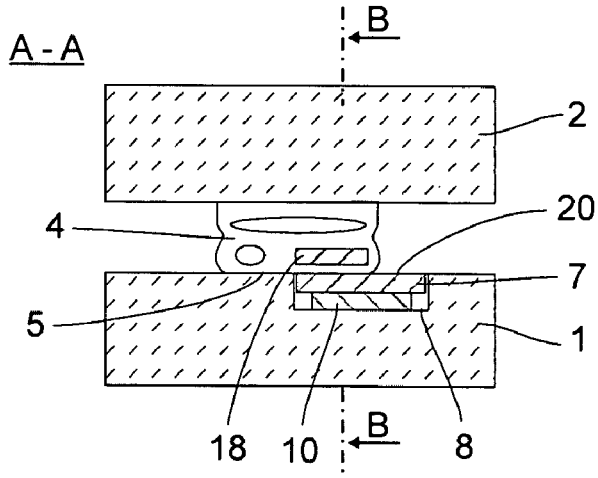
FIG. 5 shows a cross section through the arrangement shown in FIG. 4 in a plane A-A.
Figure 6:
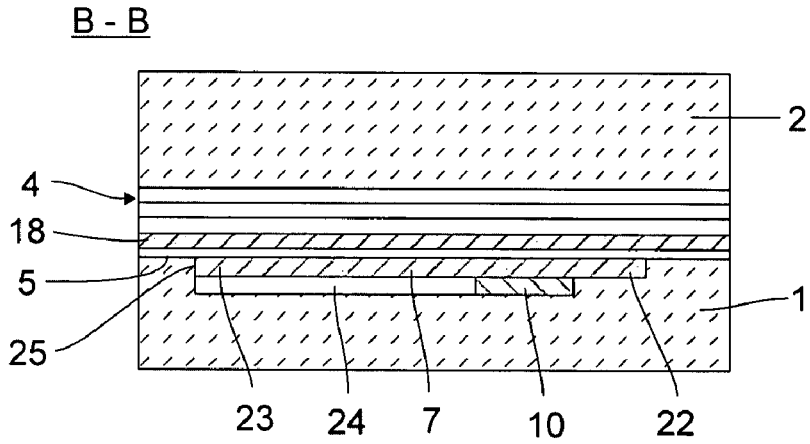
FIG. 6 shows a longitudinal section through the arrangement shown in FIG. 2 in a plane B-B.

FIGS. 4, 5 and 6 show schematic sectional views of the body 1, the door 2 and the lifting element 7 in the first shape when the door 2 is closed. In its first shape, the lifting element 7 is configured as a leaf-type strip which is completely contained in the cuboid recess 8 of the body 1 and terminates flush with the contact surface 5 of the magnetic seal 4. Furthermore, it completely fills the base surface of the recess 8. As a result, it is not possible for foreign bodies such as dirt particles to penetrate into the recess 8. The lifting element 7 is formed integrally from a thermally deformable material such as a bimetal or a shape-memory alloy, for example. It is oriented parallel with the magnetic seal 4 and therefore extends longitudinally along a part of its length.

The lifting element 7 extends transversely over only part of the width of the magnetic seal 4, but over the entire width of the chamber 18 containing a magnetic material. As a result, the lifting of the magnetic seal 4 in the region of the lifting element 7 does not additionally require a magnetic force to be overcome, but merely a partial deformation of the magnetic seal 4. The lifting element 7 and hence the recess 8 extend beyond the edge of the magnetic seal 4 on the side of the chamber 18, such that the lifting element 7 features an exposed section 20 which is not covered by the magnetic seal 4 when the door 2 is in a closed state. This allows a convective heat transfer between the lifting element 7 and the external atmosphere surrounding the refrigerating device or the air in the internal space 3 of the refrigerating device, and therefore a rapid cooling of the heated lifting element 4. In a variation from the embodiment shown in FIGS. 1 to 3, it is also possible for the lifting element 7 to be partially exposed by the magnetic seal 4 in the internal space 3 of the refrigerating device, i.e. the section 20 of the lifting element 7 is in contact with the air in the internal space 3 of the refrigerating device. This embodiment is also covered by FIGS. 4 and 5. In this case, the internal space 3 would be located to the right of the magnetic seal 4.

FIG. 6 shows a longitudinal section through the arrangement from FIGS. 4 and 5. The lifting element 7 features a first end 22 which is fixed to the body 1, and a second end 23 which is freely movable. The heating element 10 is arranged in the recess 8 underneath the first end 22 of the lifting element 7 and is covered by the lifting element 7. It is flush with the first end 22 of the lifting element 7 and extends along only part of its length, such that a hollow space 24 remains free in the recess 8 underneath the lifting element 7. As shown in FIG. 5, the heating element 10 also extends over only part of the width of the lifting element 7.

Figure 8:
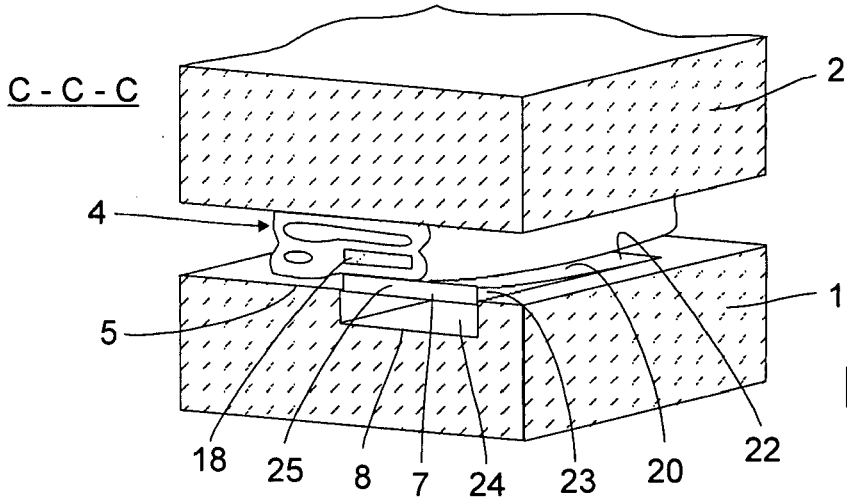
FIG. 8 shows a perspective sectional view of the arrangement from FIG. 7 in a space C-C-C.
Figure 9:
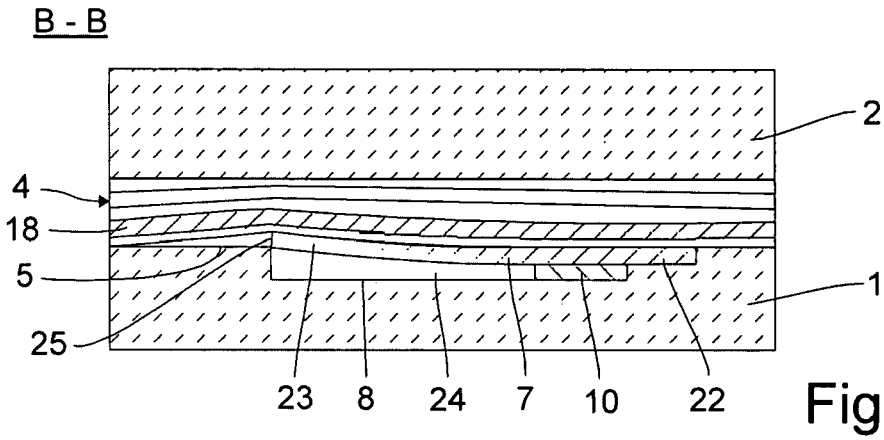
FIG. 9 shows a longitudinal section through the arrangement shown in FIG. 7 in a plane B-B.

FIGS. 7 to 9 show sectional views of the arrangement from FIGS. 7 to 9, wherein the lifting element 7 has however assumed its second shape due to heating by means of the heating element 10. In this second shape, the strip-form lifting element 7 has a curved form, in which its second, free end 23 projects above the body 1 or the contact surface 5 of the magnetic seal 4 on the body 1, touches the magnetic seal 4, presses against this and lifts it from the contact surface 5. As a result of the gap which is thus produced in front of the first end 22 of the lifting element 7, air can flow in order to equalize the pressure between the internal space 3 of the refrigerating device and the external atmosphere surrounding the refrigerating device when the door 2 is closed, whereby a negative pressure which is in the internal space 3 of the refrigerating device and hampers an opening of the door 2 can be reduced, or the development of such a negative pressure can be avoided, as described above with reference to FIGS. 1 to 3.

As shown in FIG. 8 and in particular FIG. 9, the lifting element 7 in its second shape is only curved to the extent that a face 25 which terminates the lifting element 7 at the free end 23 remains at least partially recessed in the recess 8. This ensures that no foreign matter such as dirt particles can penetrate into the recess 8 and block the lifting element 7.

Figure 10:
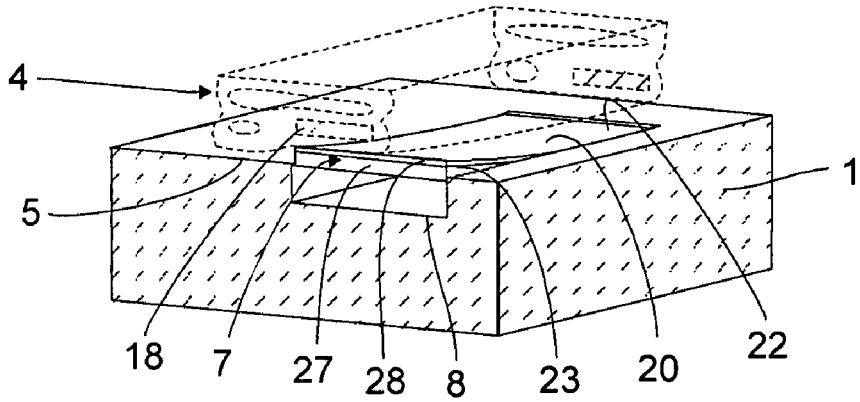
FIG. 10 shows a sectional view, corresponding to that shown in FIG. 8, of a second embodiment of the present invention.
Figure 11:
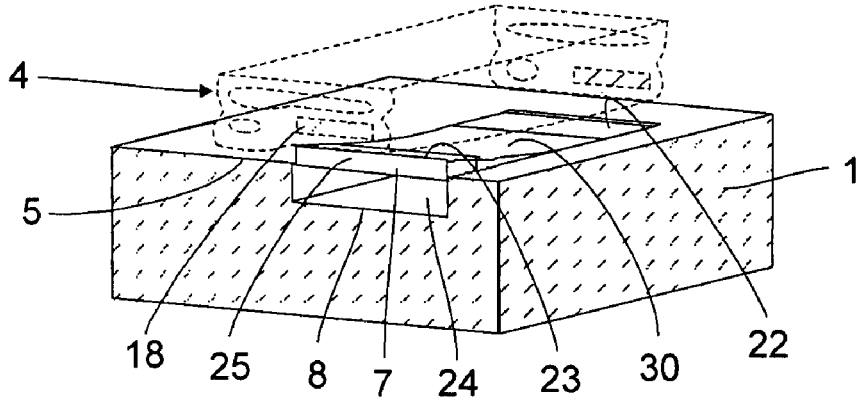
FIG. 11 shows a sectional view, corresponding to that shown in FIG. 10, of a third embodiment of the present invention.

FIGS. 10 and 11 show two further embodiments of the invention, in which the lifting element 7 has a structure which varies from that in FIGS. 1 to 9. Otherwise, these embodiments correspond to those in FIGS. 1 to 9. In order to simplify the illustration, the body 1 is not shown and the magnetic seal 4 is only shown using broken lines. In the case of the second embodiment as shown in FIG. 10, the lifting element 7 which is shown in its second shape is composed of a base layer 27, this being made of a thermally deformable material such as a shape-memory alloy or a bimetal, and a cover layer 28 which covers the entire top side of the base layer 27. The cover layer 28 serves to protect the base layer 27 against mechanical influences or chemical influences such as cleaning agents.

FIG. 11 shows a lifting element 7 which features three sections, wherein the central section 30 is made of a thermally deformable material such as a shape-memory alloy or a bimetal, and the other two sections can be made of other materials which are not thermally deformable.

Therefore, when the lifting element 7 is heated, only the central section 30 assumes a curved form, and the other two sections retain their flat form.

In addition to the embodiments including an electrical heating entity 10 as described with reference to FIGS. 1 to 11, it is alternatively possible to conceive of an embodiment in which heating of the lifting element 7 takes place by means of warm room air which flows over the lifting element 7 when the door 2 is opened, thereby causing it to assume its second shape. Only the lifting element 7 would then have to be arranged in the recess 8. The still deformed lifting element 7 would cool down after the door 2 was closed. Until it returned to its first shape, the lifting element 7 would lift up the magnetic seal 4 in the manner described above and consequently prevent the development of a negative pressure, which would hamper the opening of the door 2, in the internal space 3.

Alternatively, it is also possible to conceive of an embodiment wherein a chassis heater which is usually present in all refrigerating devices would be used for heating the lifting element 7. Any waste heat occurring in the system of the refrigerating device could therefore be used for heating the lifting element 7.

The invention claimed is:

1. A refrigerator comprising:

a.) a first housing part and a second housing part movably connected to one another, the housing parts together delimiting a heat-insulated interior space;

b.) a seal member fastened to the first housing part and operable to establish a substantially airtight seal between the first housing part and the second housing part when the two housing parts are in a closed disposition, the seal member lying on a contact surface of the second housing part when the two housing parts are in a closed disposition; and c.) a lifting element, the lifting element being formed at least partly from a temperature-dependent deformable material and the lifting element being transformable under a selected one of a thermal influence and a cold influence between a first shape in which it permits a substantially airtight seal contact between the seal member on the first housing part and the second housing part and a second shape in which the lifting element, in a closed disposition of the housing parts, maintains a portion of the seal member out of contact with the contact surface of the second housing part to thereby allow an equalization of pressure between the heat-insulated interior space and the surroundings of the refrigerator, wherein the lifting element is configured as a panel, wherein the panel is flush with the contact surface of the second housing part when the lifting element has the first shape, and wherein the panel has a curved form pressing against the seal member when the lifting element has the second shape.

2. The refrigerator as claimed in claim 1, wherein the lifting element lifts the seal member along part of its length from the contact surface.

3. The refrigerator as claimed in claim 1, wherein the lifting element is integrally formed of thermally deformable material.

4. The refrigerator as claimed in claim 1, wherein the thermally deformable material acts directly on the seal member during the configuration of the lifting element in its second shape.

5. The refrigerator as claimed in claim 1, wherein the thermally deformable material is located in a space which communicates with a selected one of the heat-insulated interior space of the refrigerator and the surroundings of the refrigerator.

6. The refrigerator as claimed in claim 1, wherein the lifting element in its first shape is arranged in a recess of the contact surface of the second housing part.

7. The refrigerator as claimed in claim 6, wherein the recess is only partially covered by the seal member when the housing parts are in a closed disposition.

8. The refrigerator as claimed in claim 6, wherein the lifting element in its second shape rises at least partially above the contact surface of the second housing part.

9. The refrigerator as claimed in claim 6, wherein the lifting element completely occupies a base surface of the recess.

10. The refrigerator as claimed in claim 1, wherein the lifting element has a first end that is attached to the second housing part and in its second shape has the curved form in which a second, free end projects above the contact surface of the second housing part and against the seal member.

11. The refrigerator as claimed in claim 1, wherein the thermally deformable material is a selected one of a bimetal and a shape-memory alloy.

12. The refrigerator as claimed in claim 1, wherein the lifting element extends over only a part of the width of the seal member.

13. The refrigerator as claimed in claim 1, wherein the seal member includes a chamber in which is received magnetic material and which extends in a longitudinal direction of the seal member and the lifting element extends over the whole width of the chamber.

14. The refrigerator as claimed in claim 1 and further comprising a heating entity for heating the lifting element.

15. The refrigerator as claimed in claim 14, wherein the heating entity is triggered by an opening or a closing of a door of the refrigerator.

16. The refrigerator as claimed in claim 15, wherein the heating entity is switched on when the door is opened and switched off when the door is closed.

17. The refrigerator as claimed in claim 14, wherein the heating entity includes an electrical heating element.

18. The refrigerator as claimed in claim 17, wherein the electrical heating element includes a PTC heating element.

19. The refrigerator as claimed in claim 1, wherein the lifting element assumes its second shape in the range from approximately 15° C. to approximately 35° C.

20. The refrigerator as claimed in claim 1, wherein the panel is one of a strip and a leaf strip.

21. The refrigerator as claimed in claim 1, wherein the panel has a first end that is attached to the second housing part and a free end, and wherein the free end of the panel projects above the contact surface of the second housing part and against the seal member.

22. The refrigerator as claimed in claim 21, wherein the free end of the panel has a face, and wherein a portion of the face is below the contact surface of the second housing part when the lifting element has the second shape.

23. The refrigerator as claimed in claim 1, wherein the second housing part includes a recess, wherein the panel is disposed in the recess such that the panel is flush with the contact surface of the second housing part when the lifting element has the first shape, wherein the panel has a first end that is attached to a surface of the recess of the second housing part and a free end, and wherein the panel has the curved form when the lifting element has the second shape such that the free end of the panel projects above the contact surface of the second housing part and against the seal member.

24. The refrigerator as claimed in claim 1, wherein the panel includes:

a base layer, the base layer being formed from the temperature-dependent deformable material; and a cover layer that covers a top side of the base layer.

25. The refrigerator as claimed in claim 1, wherein the panel includes:

a first section at a first end of the panel;

a second section at a second end of the panel; and a third section interposing the first section and the second section, the third section being formed from the temperature-dependent deformable material.

26. The refrigerator as claimed in claim 25, wherein the first section and the second section are not formed from the temperature-dependent deformable material.

* * * * *